US012624595B2

(12) United States Patent
Richards

(10) Patent No.: US 12,624,595 B2
(45) Date of Patent: May 12, 2026

(54) BIAS TOOL PAD ACTUATOR

(71) Applicant: Schlumberger Technology Corporation, Sugar Land, TX (US)

(72) Inventor: Edward Richards, Cheltenham (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 29 days.

(21) Appl. No.: 18/883,693

(22) Filed: Sep. 12, 2024

(65) Prior Publication Data

US 2026/0071499 A1 Mar. 12, 2026

(51) Int. Cl.
*E21B 7/06* (2006.01)

(52) U.S. Cl.
CPC ..... *E21B 7/06* (2013.01)

(58) Field of Classification Search
CPC ..... E21B 7/06; E21B 7/10
See application file for complete search history.

(56) References Cited

U.S. PATENT DOCUMENTS 3,424,256 A * 1/1969 Jeter ..... E21B 7/06 175/76
3,637,032 A * 1/1972 Jeter ..... E21B 7/06 175/73
4,394,881 A * 7/1983 Shirley ..... E21B 7/062 166/319
8,157,024 B2 4/2012 De Paula Neves et al.
8,474,552 B2 7/2013 De Paula Neves et al.
10,683,702 B2 6/2020 Conger et al.
11,396,774 B2 7/2022 Chambers et al.
12,180,833 B1 12/2024 Zhang
2002/0140184 A1* 10/2002 Janoff ..... F16J 15/0887 277/644
2004/0089477 A1* 5/2004 Moody ..... E21B 7/06 175/73
2006/0196539 A1* 9/2006 Raska ..... E21B 34/063 137/68.24
2019/0128071 A1* 5/2019 Conger ..... E21B 34/06
2020/0263501 A1* 8/2020 Doud ..... F16J 9/14
2022/0268102 A1* 8/2022 Zhang ..... E21B 7/068
2025/0003291 A1* 1/2025 Zhang ..... E21B 7/06
2025/0314160 A1* 10/2025 Shaw ..... F16K 15/00

* cited by examiner

*Primary Examiner* — Shane Bomar
(74) *Attorney, Agent, or Firm* — Jeffrey D. Frantz

(57) ABSTRACT

A device may include a tool housing having an outer surface. A device may include a movable biasing element radially movable relative to the outer surface. A device may include a bore in the outer surface of the tool housing at least partially in a radial direction of the tool housing. A device may include a piston axially fixed to the movable biasing element and movable in the bore. A device may include a pressure ring coupled to the piston and positioned between at least a portion of the piston and an inner wall of the bore.

20 Claims, 7 Drawing Sheets

BIAS TOOL PAD ACTUATOR

BACKGROUND

For drilling of a borehole, directional drilling allows creation of a non-linear borehole or a linear borehole through varying earth formations. Directional drilling units contain actuatable pads to apply lateral forces and steer a bit.

SUMMARY

In some aspects, the techniques described herein relate to a downhole tool including: a tool housing having an outer surface; a movable biasing element radially movable relative to the outer surface; a bore in the outer surface of the tool housing at least partially in a radial direction of the tool housing; a piston axially fixed to the movable biasing element and movable in the bore; and a pressure ring coupled to the piston and positioned between at least a portion of the piston and an inner wall of the bore.

In some aspects, the techniques described herein relate to a downhole tool including: a tool housing having an outer surface; a movable biasing element radially movable relative to the outer surface; a bore in the outer surface of the tool housing at least partially in a radial direction of the tool housing; and a piston operably coupled with the movable biasing element and axially movable in the bore and rotatable in the bore around a transverse axis in a transverse direction to an axial direction of the bore.

In some aspects, the techniques described herein relate to a downhole tool including: a tool housing having an outer surface; a movable biasing element radially movable relative to the outer surface; a bore in the outer surface of the tool housing at least partially in a radial direction of the tool housing; a piston movable in the bore, wherein the piston includes a pressure ring coupled to the piston and positioned between at least a portion of the piston and an inner wall of the bore; and a connecting rod axially coupling to the movable biasing element and the piston, wherein the connecting rod is rotatably connected to the movable biasing element and rotatably connected to the piston.

This summary is provided to introduce a selection of concepts that are further described below in the detailed description. This summary is not intended to identify key or essential features of the claimed subject matter, nor is it intended to be used as an aid in limiting the scope of the claimed subject matter.

Additional features and aspects of embodiments of the disclosure will be set forth in the description which follows, and in part will be obvious from the description, or may be learned by the practice of such embodiments. The features and aspects of such embodiments may be realized and obtained by means of the instruments and combinations particularly pointed out in the appended claims. These and other features will become more fully apparent from the following description and appended claims or may be learned by the practice of such embodiments as set forth hereinafter.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, non-schematic drawings should be considered as being to scale for some embodiments of the present disclosure, but not to scale for other embodiments contemplated herein. Understanding that the drawings depict some example embodiments, the embodiments will be described and explained with additional specificity and detail through the use of the accompanying drawings in which:

FIG. 4-1 and 4-2 are side cross-sectional views of a piston moving in a toroidal bore.

FIG. 7-1 and 7-2 are side cross-sectional views of a piston moving in a linear bore.

DETAILED DESCRIPTION

Embodiments of the present disclosure generally relate to devices, systems, and methods for controlling a downhole tool in a downhole environment. Embodiments of the present disclosure generally relate to devices, systems, and methods for directional drilling. In some embodiments, systems and methods according to the present disclosure allow for the selective cutting, drilling, milling, reaming, degrading, or otherwise removing material to steer a drill bit in a downhole environment. In some embodiments, systems and methods according to the present disclosure allow for the removal of material from formation in a lateral direction during drilling of the borehole. In some embodiments, systems and methods according to the present disclosure allow for the removal of material from the formation based at least partially on information received from one or more sensors in the bottomhole assembly. It should be understood that while the present disclosure will describe the systems and methods for directional drilling of a wellbore, it should be understood that the present disclosure is applicable to any downhole device with actuatable structures on a lateral surface during or after the creation of a borehole.

Figure 1:
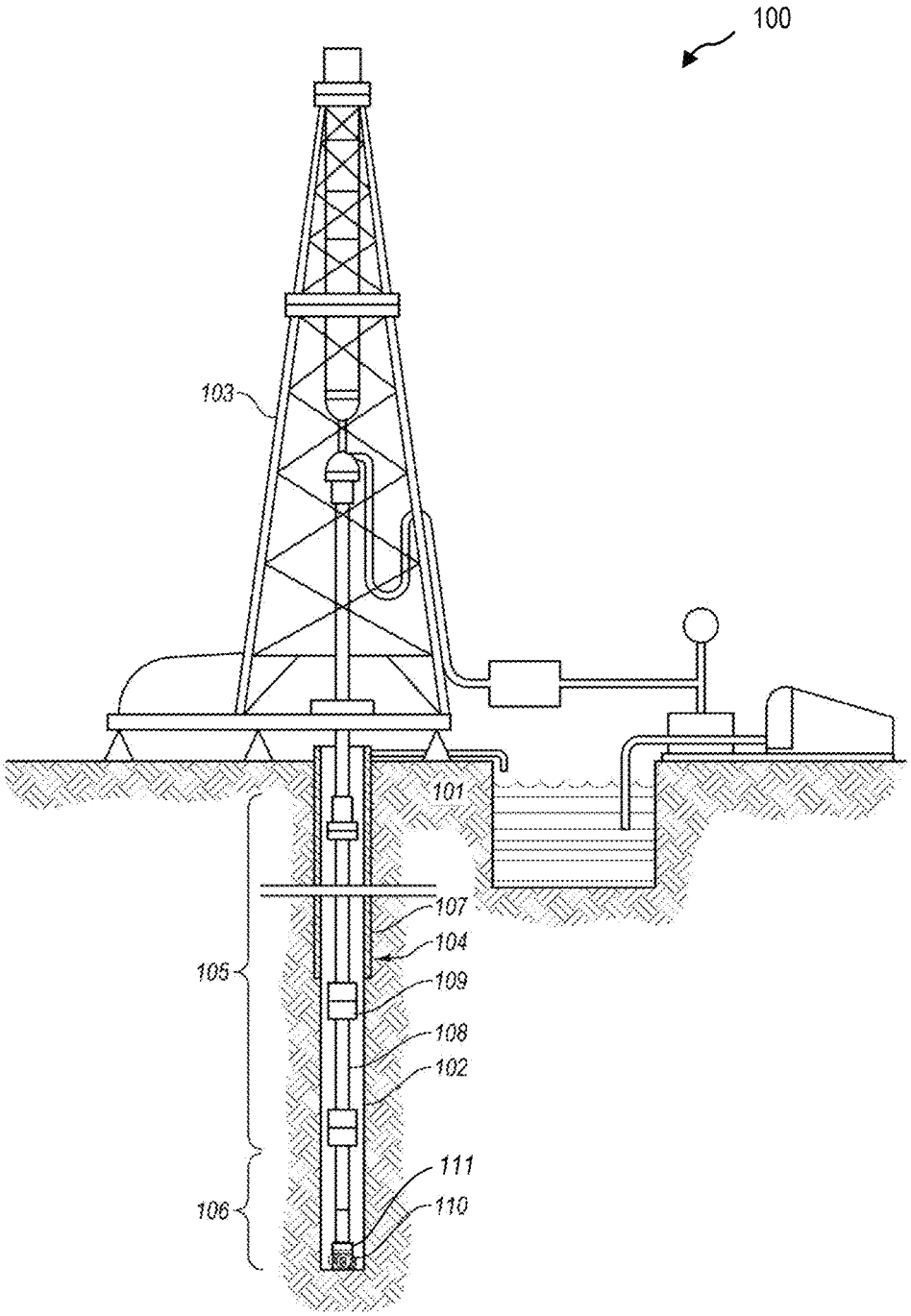
FIG. 1 illustrates a drilling system and downhole environment, according to some embodiments of the present disclosure.

FIG. 1 illustrates an embodiment of a drilling system and downhole environment. FIG. 1 shows one example of a drilling system 100 for drilling an earth formation 101 to form a wellbore 102. The drilling system 100 includes a drill rig 103 used to turn a drilling assembly 104 which extends downward into the wellbore 102. The drilling assembly 104 may include a drill string 105 and a bottomhole assembly (BHA) 106 attached to the downhole end of the drill string 105. Where the drilling system 100 is used for drilling formation, a drill bit 110 can be included at the downhole end of the BHA 106.

The drill string 105 may include several joints of drill pipe 108 connected end-to-end through tool joints 109. The drill string 105 transmits drilling fluid through a central bore and can transmit rotational power from the drill rig 103 to the BHA 106. In some embodiments, the drill string 105 may further include additional components such as subs, pup joints, etc. The drill pipe 108 provides a hydraulic passage through which drilling fluid 111 is pumped from the surface. The drilling fluid 111 discharges through selected-size nozzles, jets, or other orifices in the bit 110 for the purposes of cooling the bit 110 and cutting structures thereon, for lifting cuttings out of the wellbore 102 as it is being drilled, and for preventing the collapse of the wellbore 102. The drilling fluid 111 carries drill solids including drill fines, drill cuttings, and other swarf from the wellbore 102 to the surface. The drill solids can include components from the earth formation 101, the drilling assembly 104 itself, from other man-made components (e.g., plugs, lost tools/components, etc.), or combinations thereof.

The BHA 106 may include the bit 110 or other components. An example BHA 106 may include additional or other components (e.g., coupled between to the drill string 105 and/or the bit 110). Examples of additional BHA components include drill collars, stabilizers, measurement-while-drilling (MWD) tools, logging-while-drilling (LWD) tools, downhole motors, underreamers, directional steering tools, section mills, hydraulic disconnects, jars, vibration dampening tools, other components, or combinations of the foregoing.

In general, the drilling system 100 may include other drilling components and accessories, such as special valves (e.g., kelly cocks, blowout preventers, safety valves, centrifuges, shaker tables, and rheometers). Additional components included in the drilling system 100 may be considered a part of the surface system (e.g., drill rig 103, drilling assembly 104, drill string 105, or a part of the BHA 106, depending on their locations and/or use in the drilling system 100).

The bit 110 in the BHA 106 may be any type of bit suitable for degrading downhole materials. For instance, the bit 110 may be a drill bit suitable for drilling the earth formation 101. Example types of drill bits used for drilling earth formations are fixed-cutter or drag bits, roller cone bits, impregnated bits, or coring bits. In other embodiments, the bit 110 may be a mill used for removing metal, composite, elastomer, other materials downhole, or combinations thereof. For instance, the bit 110 may be used with a whipstock to mill into casing 107 lining the wellbore 102. The bit 110 may also be a junk mill used to mill away tools, plugs, cement, other materials within the wellbore 102, or combinations thereof. Swarf or other cuttings formed by use of a mill may be lifted to surface by the drilling fluid 111 or may be allowed to fall downhole. The conditions of the equipment of the drilling system 100, the formation 101, the wellbore 102, the drilling fluid 111, or other part of the wellsite can change during operations.

Figure 2:
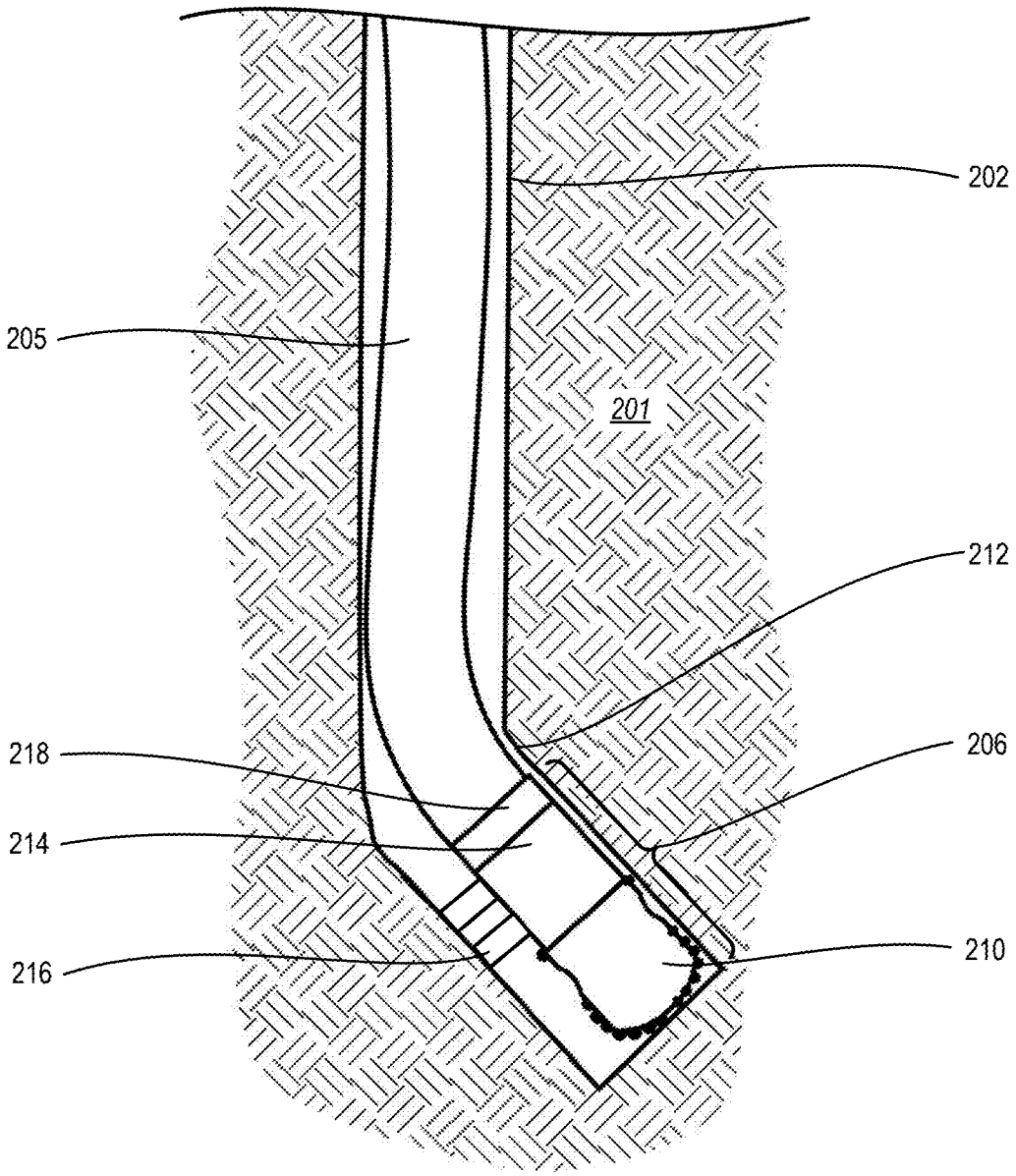
FIG. 2 is a side view of a downhole environment in which a BHA and drill string steer the bit to create a curve of a borehole, according to some embodiments of the present disclosure.

In some embodiments, the BHA 106 includes one or more biasing units that allow an operator to steer the bit 110 relative to the earth formation 101 as the drilling assembly 104 rotates in the wellbore 102. For example, FIG. 2 is a side view of an embodiment of a downhole environment in which a BHA 206 and drill string 205 steer the bit 210 to create a curve of a borehole 202.

In some embodiments, a portion of the BHA 206 and/or drill string 205 contacts a radially inward surface 212 of the borehole 202 as the BHA 206 and drill string 205 follow the curve. In some embodiments, when the BHA 206 and drill string 205 contact the formation 201 of the borehole surface, the BHA 206 and drill string 205 experience damage from the formation 201. In some embodiments, when the BHA 206 and drill string 205 contact the formation 201 of the borehole surface, the BHA 206 and drill string 205 experience drag, in the longitudinal direction and/or the rotational direction, placing additional strain on the drilling system and components thereof. Precise control of steering the BHA 206 and the bit 210 with a directional steering tool 214 allows the drilling system to limit and/or prevent damage to the BHA 206 and drill string 205 in non-linear boreholes 202.

In some embodiments, a directional steering tool 214 is a discrete steering tool that is coupled to a drill bit 210. In some embodiments, the directional steering tool 214 is the drill bit with an integrated biasing element or steering element. For example, a directional steering tool 214 includes at least one actuatable biasing element 216 configured to actuate radially outward from a rotational axis of the BHA 206 and drill string 205. As the BHA 206 and drill string 205 rotate, the actuatable biasing element 216 is actuated between a closed position and an open position to selectively apply a lateral force to the borehole wall. The drill bit 210 is urged in an opposing lateral direction to steer the drill bit 210 in the direction of the borehole 202.

In some embodiments, an MWD unit 218 allows for measurements of a plurality of operating conditions, environmental conditions, fluid measurements, or other status information regarding the performance and/or condition of the downhole tool and the downhole environment in which the downhole tool is operating. In some embodiments, the MWD unit 218 measures and/or records directional information of the downhole tool. In some examples, the MWD unit 218 includes accelerometers and/or magnetometers to measure the inclination and azimuth of the borehole at the measured location. In some embodiments, the MWD unit 218 includes survey gyroscopes that allow directional and/or movement information, such as inclination, azimuth, velocity, and other values. In some embodiments, the MWD unit 218 records the directional measurements. In some embodiments, the MWD unit 218 transmits the measurements to a system and/or operator at the surface.

In some embodiments, the MWD unit 218 measures and/or records drilling mechanics information. In some embodiments, the drilling mechanics information includes a rotational speed of the drill string; variation (vibration) in the rotational speed; amplitude, frequency, and mode of vibrations of the drill string; downhole temperature; torque on bit; weight on bit; mud flow volume; other drilling mechanics information; and combinations thereof. In some embodiments, the MWD unit 218 records the drilling mechanics information. In some embodiments, the MWD unit 218 transmits the drilling mechanics information to a system and/or operator at the surface.

Figure 3:
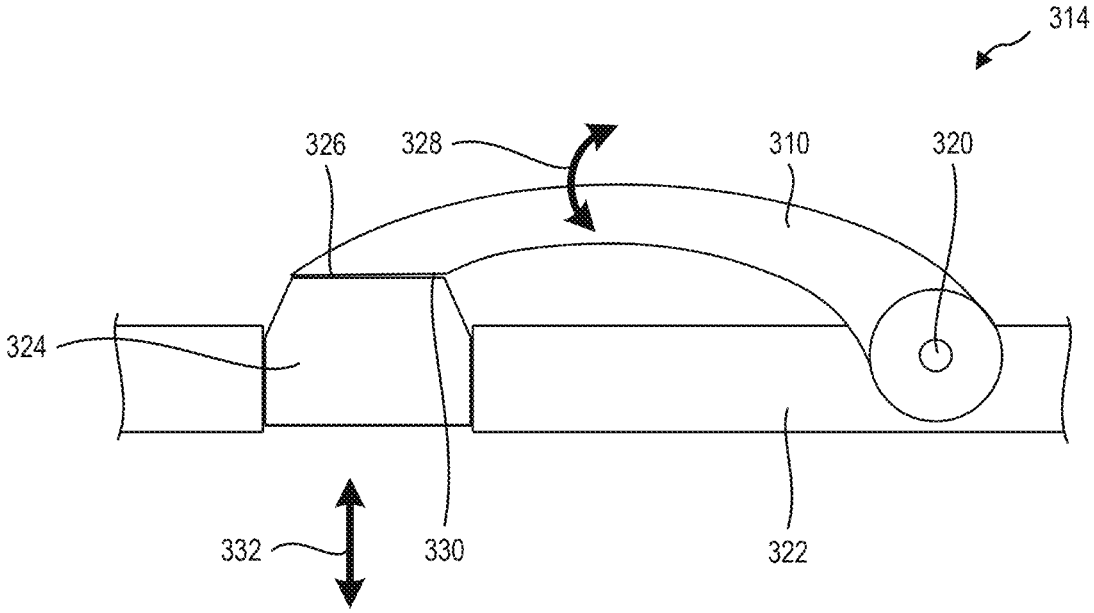
FIG. 3 is a side cross-sectional view of a directional steering tool including at least one actuatable biasing element configured to actuate radially outward from a rotational axis of the BHA and/or drill string.

FIG. 3 is a side cross-sectional view of a directional steering tool 314 including at least one actuatable biasing element 310 configured to actuate radially outward from a rotational axis of the BHA (such as the BHA 206 of FIG. 2) and/or drill string (such as drill string 105 of FIG. 1). In some embodiments, the actuatable biasing element 310 is movable around a hinged connection 320 to the tool housing 322 of the directional steering tool 314. In some embodiments, the actuatable biasing element 310 is urged radially outward by a hydraulic actuator including a piston 324. The linear movement of the piston 324 in the hydraulic actuator urges the actuatable biasing element 310 through an arcuate range of motion 328 relative to the hinged connection 320.

A top surface 326 of the piston 324 applies a radially outward force to the actuatable biasing element 310, and the top surface 326 slides relative to a contact surface 330 of the actuatable biasing element 310 as the actuatable biasing element 310 rotates through the arcuate range of motion. While this geometry allows for a hydraulic actuator to apply a radially outward force to the actuatable biasing element 310, the lack of axial coupling (relative to an axial direction 332 of the piston 324) between the piston 324 and the actuatable biasing element 310 prevents the piston 324 from applying a radially inward force (e.g., tension force) to the actuatable biasing element 310.

Figures 1, 4:
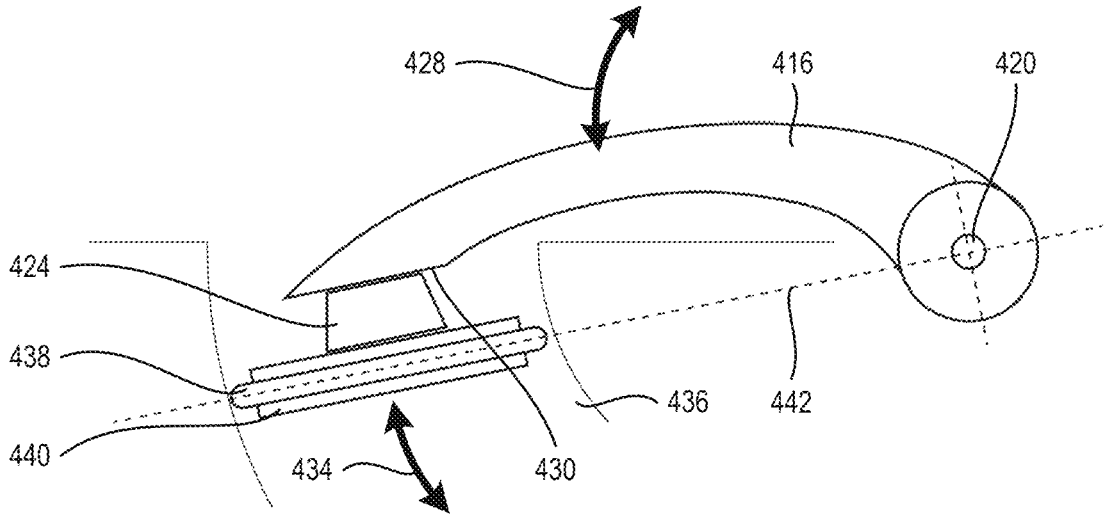
Figures 2, 4:
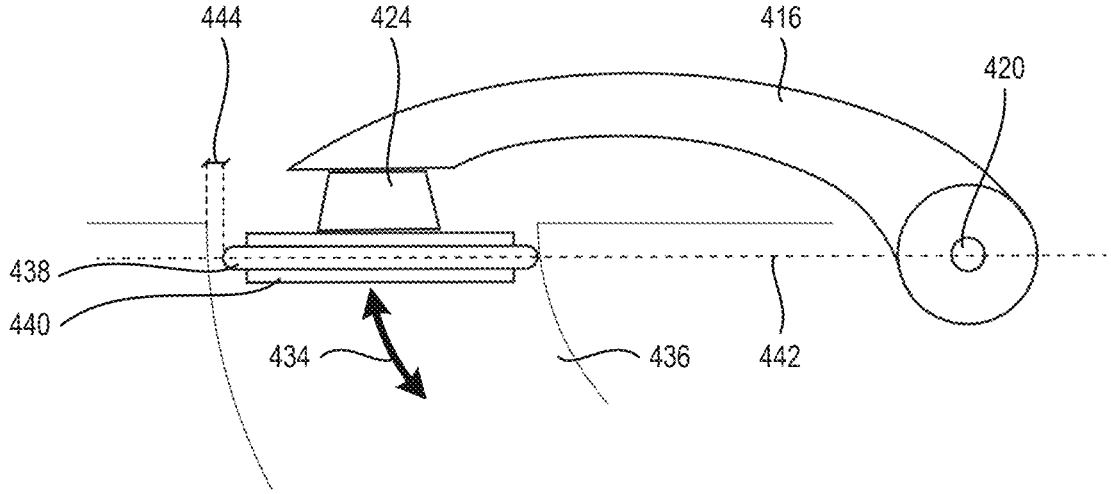

The piston may be axially coupled to the actuatable biasing element when the piston moves in a toroidal bore with a substantially similar arcuate path of the actuatable biasing element. FIG. 4-1 and FIG. 4-2 illustrate a side view of an embodiment of a directional steering tool, according to the present disclosure. In some embodiments, the piston 424 is coupled to the actuatable biasing element 416 and is fixed relative to the actuatable biasing element 416. As the actuatable biasing element 416 moves through an arcuate range of motion 428 relative to the hinged connection 420, in some embodiments, the piston 424 moves in an arcuate path 434 that is substantially similar to the arcuate range of motion 428 of the actuatable biasing element 416.

In some embodiments, the piston 424 moves within a toroidal bore 436. In some embodiments, the toroidal bore 436 has a radius of curvature that is substantially equal to the radius of the contact surface 430 of the actuatable biasing element 416 relative to the hinged connection 420. For example, the arcuate path 434 of the piston 424 coupled to the contact surface 430 of the actuatable biasing element 416 both follow the same path as the actuatable biasing element 416 moves through the arcuate range of motion 428. In some embodiments, a surface of the toroidal bore 436 is a superhard or ultrahard material. For example, the toroidal bore 436 may be formed in a solid tungsten carbide body. In some examples, the toroidal bore 436 has a superhard or ultrahard liner (e.g., sleeve) positioned therein to provide a superhard or ultrahard surface thereof. In another example, the toroidal bore 436 may be formed in a steel body with an ultrahard coating deposited thereon. In at least one example, the toroidal bore 436 is formed by machining the bore into a portion of the directional steering tool body or housing. In at least one example, the toroidal bore 436 is formed by additive manufacturing of a portion of the directional steering tool body or housing. In at least one example, the toroidal bore 436 is formed by casting the bore into a portion of the directional steering tool body or housing.

In some conventional hydraulic pistons, an elastomeric seal around a lateral edge of the piston between the piston and the bore provides a fluid seal between the piston and the bore. In a downhole environment, the environmental conditions and fluid properties damage elastomeric seals. In some embodiments, a piston 424, according to the present disclosure, includes a pressure ring 438 coupled to the piston body 440. The pressure ring 438 includes a superhard or ultrahard material to resist wear in the downhole environment, as will be described in more detail herein. In some embodiments, the pressure ring 438 has a circular outer perimeter (i.e., circumference). In some embodiments, the pressure ring 438 is an annular ring around a portion of the piston body 440 and between the piston 424 and the inner diameter of the bore 436.

In some embodiments, the pressure ring 438 is oriented on the piston 424 to align with the radial direction 442 of the hinged connection 420. When used in conjunction with a toroidal bore 436 with a radius of curvature based on the hinged connection 420, a pressure ring 438 in-plane with the radial direction 442 remains fixed in a position normal to the arcuate path 434 of the piston 424 in the toroidal bore 436, as illustrated in FIG. 4-2. In some embodiments, a circular or annular pressure ring 438 that is in-plane with the radial direction 442 is rotatable relative to the toroidal bore 436 in-plane with the radial direction 442. For example, the pressure ring 438 may experience wear from contact with the wall of the bore 436 and/or erosion from fluid flow through a gap 444 between the outermost edge of the pressure ring 438 (radially outermost relative to a center of the pressure ring 438) and the wall of the bore 436. A pressure ring 438 that is rotatable relative to the piston body 440 allows the pressure ring 438 to experience the wear and/or erosion distributed around a broader region of the pressure ring 438, increasing the operational lifetime of the device.

In some embodiments, the pressure ring is non-circular and/or non-annular. For example, the pressure ring 438 may be complementarily shaped to a cross-section of the bore 436 to fit in the bore 436 and receive fluid pressure across a surface of the pressure ring 438, but the pressure ring 438 and the cross-sectional shape of the bore 436 may be non-circular, such as elliptical, square, rectangular, hexagonal, other regular or irregular polygonal, regular or irregularly curved, or combinations thereof. Such a shape of the pressure ring 438 and the cross-sectional shape of the bore 436 limits and/or prevents rotation of the pressure ring 438 relative to the cross-sectional shape of the bore 436. In some embodiments, limiting rotation of the pressure ring 438 relative to the bore 436 controls the relative position of the pressure ring 438 and the wall of the bore 436 when more precise tolerances are desired.

In some embodiments, a plane of the pressure ring 438 is oriented at an angle to the radial direction 442. For example, an elliptical pressure ring 438 oriented at an angle to the arcuate path 434 of the piston 424 complementarily fits in a toroidal bore 436 with a circular cross-sectional shape transverse to the axial direction of the bore 436. An elliptical pressure ring 438 in a bore 436 with a circular cross-sectional shape limits and/or prevents rotation of the pressure ring 438 in the bore 436 and/or directs fluid flow (and erosion associated therewith) to a region of the gap 444 between the pressure ring 438 and the bore wall.

In some embodiments, the gap 444 between the pressure ring 438 and the wall of the bore 436 allows for larger machining and/or manufacturing tolerances. Precise manufacturing or dimensions or surface finish can be challenging with ultrahard materials. A pressure ring 438 including ultrahard materials, however, has increased erosion resistance relative to a conventional elastomeric seal, allowing the pressure ring 438 to experience fluid flow through the gap 444 without significant erosion. In some embodiments, the gap 444 is in a range having an upper value, a lower value, or upper and lower values including any of 1% of a diameter (such as the diameter 548 described in relation to FIG. 5 or another maximum transverse dimension) of the pressure ring 438, 2%, 3%, 5%, or any values therebetween of the diameter (or other maximum transverse dimension) of the pressure ring 438.

Figure 5:
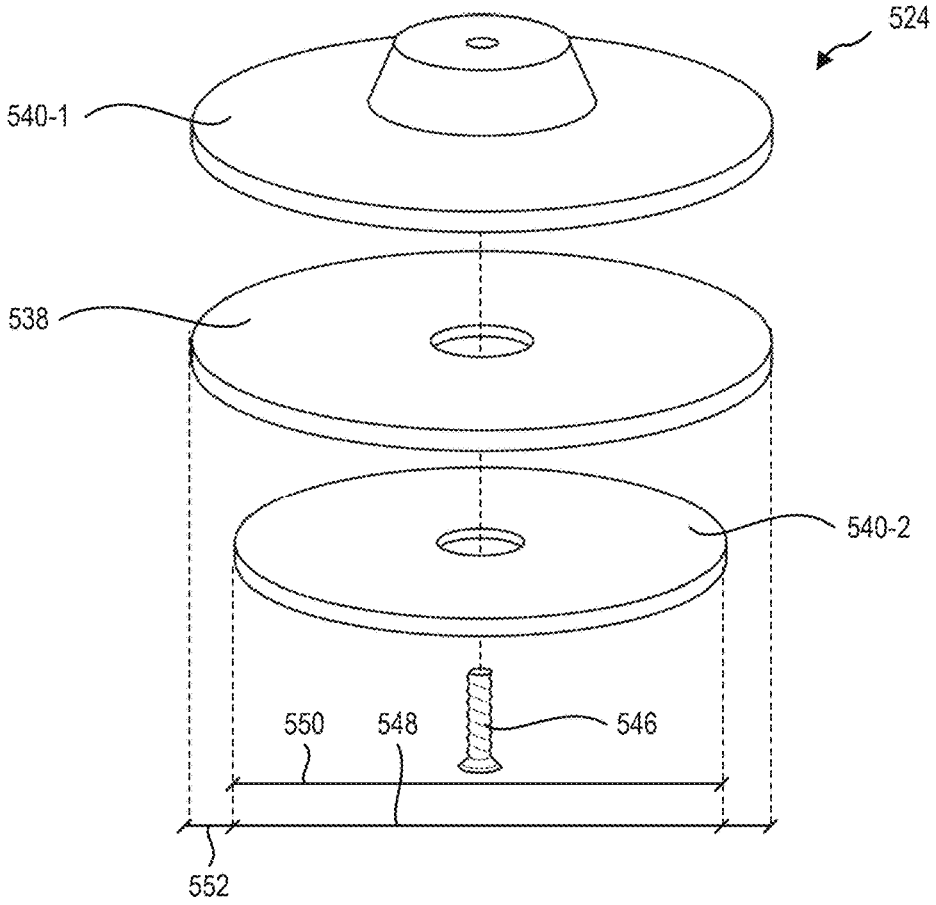
FIG. 5 is an exploded view of an embodiment of a piston, according to the present disclosure.

FIG. 5 is an exploded view of an embodiment of a piston 524, according to the present disclosure. The piston 524 includes a pressure ring 538 that is captured between a first portion of the piston body 540-1 and a second portion of the piston body 540-2. In some embodiments, a threaded fastener 546 couples the pressure ring 538 to the piston body

540-1, 540-2. In some embodiments, the threaded fastener 546 couples the first portion of the piston body 540-1 to the second portion of the piston body 540-2, and the pressure ring 538 is captured therebetween, although the threaded fastener 546 may or may not directly contact the pressure ring 538. In some embodiments, the fastener or other mechanism that connects the pressure ring 538 to the piston 524 also connects the piston 524 to the actuatable biasing element (such as coupled to the contact surface 430 described in relation to FIG. 4-1). In some embodiments, the piston 524 is coupled to the actuatable biasing element (e.g., axially coupled as described in relation to FIG. 3) by a different and/or separate connection mechanism.

While FIG. 5 illustrates an embodiment of a piston 524 with a central threaded fastener 546, in other embodiments, additional or other fasteners or fastening mechanisms are included. For example, a piston may include two or more fasteners in addition to a central fastener. In some examples, a piston includes two or more fasteners and lack a central fastener. In some examples, a piston includes an adhesive that bonds the pressure ring to the piston body. In some examples, a piston includes a magnetic connection that retains the pressure ring against or in the piston body.

In some embodiments, an outermost edge of the pressure ring 538 has a ring diameter 548 (or other maximum dimension for non-circular pressure rings) that is greater than a body diameter 550 of the piston body 540-1, 540-2. The prominence 552 of the pressure ring 538 beyond the piston body 540-1, 540-2 in the transverse direction is, in some embodiments, in a range having an upper value, a lower value, or upper and lower values including any of 1% of the ring diameter (or another maximum transverse dimension) of the pressure ring 538, 2%, 3%, 5%, 10%, or any values therebetween of the ring diameter 548 (or other maximum transverse dimension). For example, the prominence 552 is greater than 1% of the ring diameter 548. In some examples, the prominence 552 is less than 10% of the ring diameter 548. In some examples, the prominence 552 is between 1% and 10% of the ring diameter 548. In some examples, the prominence 552 is between 2% and 5% of the ring diameter 548.

In some embodiments, the pressure ring 538 is a monolithic component. In some examples, the pressure ring 538 is a single continuous piece of polycrystalline diamond (PCD). In some examples, the pressure ring 538 is a single continuous piece of tungsten carbide (WC). In some examples, the pressure ring 538 is a single continuous piece of silicon carbide (SiC). In some examples, the pressure ring 538 is a single continuous piece of cubic boron nitride (cBN). In some embodiments, the pressure ring 538 is a multi-component pressure ring. For example, the pressure ring may include a plurality of angular segments in the plane of the pressure ring. In some examples, the pressure ring includes a plurality of concentric components, such as a series of angular rings that nest concentrically within one another. In such an example, an outermost annulus of the pressure ring is a superhard or ultrahard material, and another portion of the pressure ring concentrically within the outermost annulus includes a second material, such as tool steel. For example, an outermost annulus of diamond provides greater erosion resistance and a lower coefficient of friction than the tool steel portion of the pressure ring concentrically within the outermost annulus, while the tool steel is easier to machine threads into for a threaded connection.

Figure 6:
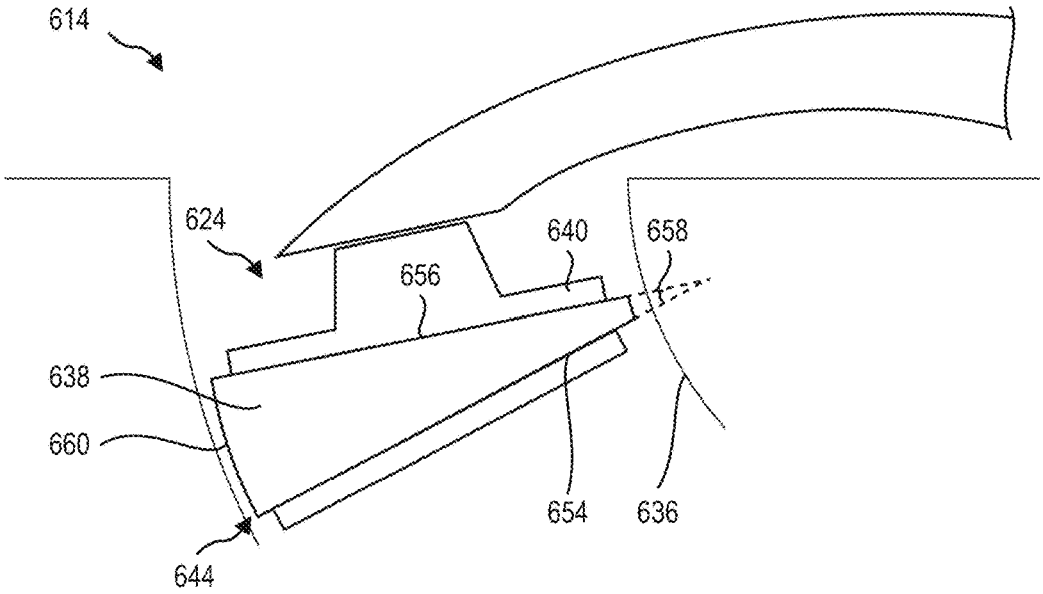
FIG. 6 is a side cross-sectional view of an embodiment of a directional steering tool with a wedge pressure ring.

While embodiments of pressure rings have been described and illustrated herein with a constant thickness in the axial direction, in some embodiments, a pressure ring has a non-uniform thickness. FIG. 6 is a side cross-sectional view of an embodiment of a directional steering tool 614 with a wedge pressure ring 638. In some embodiments, the piston 624 has a pressure ring 638 coupled to or captured in a piston body 640 where a first surface 654 and a second surface 656 of the pressure ring 638 are non-parallel to one another. For example, at least a portion of the first surface 654 and the second surface 656 form a wedge angle 658. In some embodiments, the wedge angle 658 is in a range having an upper value, a lower value, or an upper and lower value including any of 1°, 2°, 3°, 4°, 5°, 6°, 8°, 10°, or any values therebetween. In some examples, the wedge angle 658 is greater than 1°. In some examples, the wedge angle 658 is less than 10°. In some examples, the wedge angle 658 is between 1° and 10°. In at least one embodiment, the wedge angle 658 is between 1° and 5°. A wedge pressure ring 638 further limits and/or prevents rotation of the pressure ring 638 relative to the piston body 640 and/or in the bore 636.

In some embodiments, the wedge pressure ring 638 has a greater erosive volume to last longer during operation. For example, the flow rate of a hydraulic fluid may be greater through the gap 644 with the toroidal bore 636 at the radially outermost edge 660 of the pressure ring 638 (relative to the hinged connection, such as described in relation to FIG. 4-1 and 4-2). In some embodiments, an edge of the pressure ring 638 (e.g., radially outermost edge 660 or any edge of any embodiment of a pressure ring described herein) is rounded. In some embodiments, an edge of the pressure ring 638 is tapered. In some embodiments, an edge of the pressure ring 638 is squared with discontinuous corners. In some embodiments, at least a portion of the edge is radiused (i.e., curved) and at least a portion of the edge is linear.

Figures 1, 7:
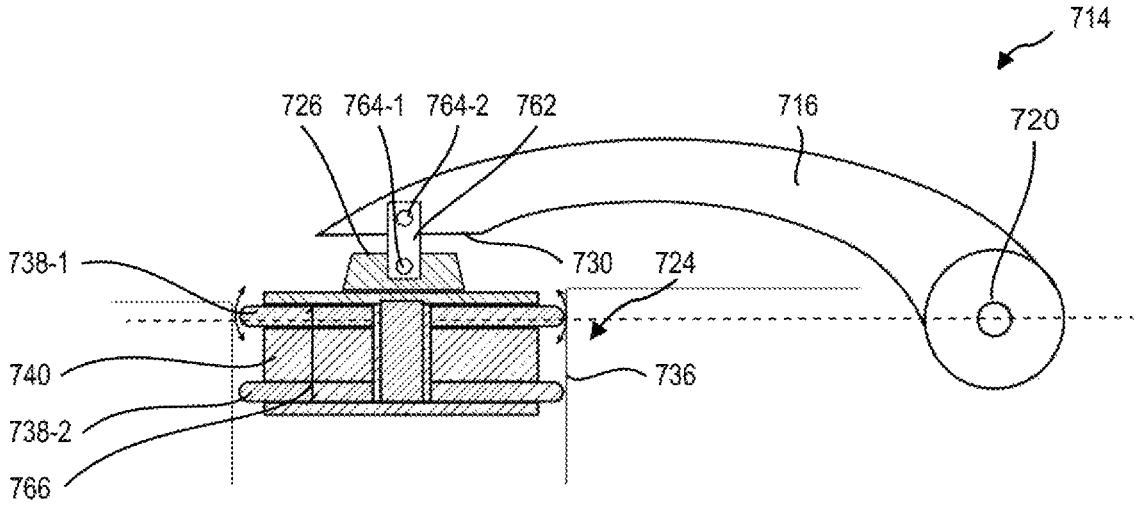
Figures 2, 7:
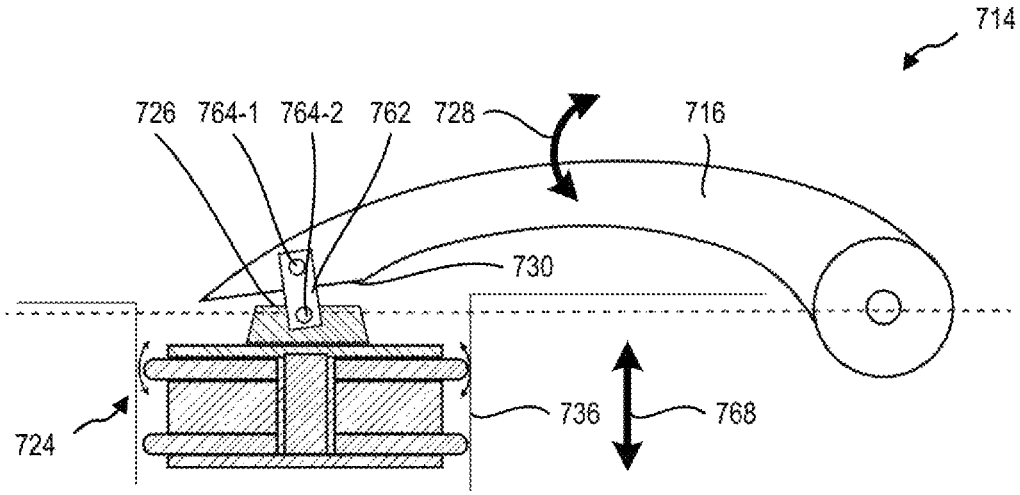

FIG. 7-1 and FIG. 7-2 are side cross-sectional views of another embodiment of a directional steering tool 714. In some embodiments, the piston 724 moves within a linear bore 736. To accommodate the lateral component of the contact surface 730 of the actuatable biasing element 716 during the arcuate range of motion 728 relative to the piston 724, a connecting rod 762 axially couples the piston 724 to the actuatable biasing element 716. The connecting rod 762 is rotatably coupled to the piston 724 at a first rotatable connection 764-1 (e.g., proximate to the top surface 726), and the connecting rod 762 is rotatably coupled to the contact surface 730 (or another portion of the actuatable biasing element 716) at a second rotatable connection 764-2. In some embodiments, the rotatable connection is a hinged connection with a single rotational axis. In some embodiments, the rotatable connection includes a plurality of rotational axis, such as a universal joint including a plurality of hinged connections. In some embodiments, the rotatable connection is a ball-and-socket connection that allows additional axes of rotation.

In some embodiments, a piston 724 axially coupled to the actuatable biasing element 716 with a connecting rod 762 with rotatable connections able to rotate independently of actuatable biasing element 716. A pressure ring or plurality of pressure rings 738-1, 738-2 with an axial length 766 of at least 10% of the ring diameter, limits and/or prevents unintended rotation of the piston 724 relative to the bore 736. In some embodiments, the axial length 766 of the pressure ring or plurality of pressure rings 738-1, 738-2 is at least 20% of the ring diameter. In some embodiments, the axial length 766 of the pressure ring or plurality of pressure rings 738-1, 738-2 is at least 30% of the ring diameter.

In some embodiments, the piston 724 has a first pressure ring 738-1 and a second pressure ring 738-2 that defines an axial length 766 from the first pressure ring 738-1 to the second pressure ring 738-2. In some embodiments, the piston 724 includes a third pressure ring in addition to the first pressure ring 738-1 and the second pressure ring 738-2. In some embodiments, the first pressure ring 738-1 is the same as the second pressure ring 738-2. For example, it may be beneficial to have redundant and/or shared parts between the first pressure ring 738-1 and the second pressure ring 738-2. In some embodiments, the first pressure ring 738-1 and second pressure ring 738-2 are different. In some examples, the first pressure ring 738-1 and second pressure ring 738-2 include different materials, such as the first pressure ring 738-1 being or including diamond and the second pressure ring 738-2 being or including cBN. In some examples, the first pressure ring 738-1 and second pressure ring 738-2 have different thicknesses (e.g., axial lengths). In some examples, the first pressure ring 738-1 and second pressure ring 738-2 have different ring diameters. In some examples, the first pressure ring 738-1 and second pressure ring 738-2 have different prominences beyond the sides of the piston body 740.

Referring now to FIG. 7-2, the linkage of the connecting rod 762 through two rotatable connections 764-1, 764-2 allows the relative lateral movement between the contact surface 730 and the top surface 726. The connecting rod 762 is, therefore, able to rotate relative to the piston 724 while the piston 724 moves in a linear path 768 through the linear bore 736 (or linear portion of the bore 736), and the connecting rod 762 is able to rotate relative to the contact surface 730 of the actuatable biasing element 716 while the actuatable biasing element 716 rotates around the hinged connection 720.

Figure 8:
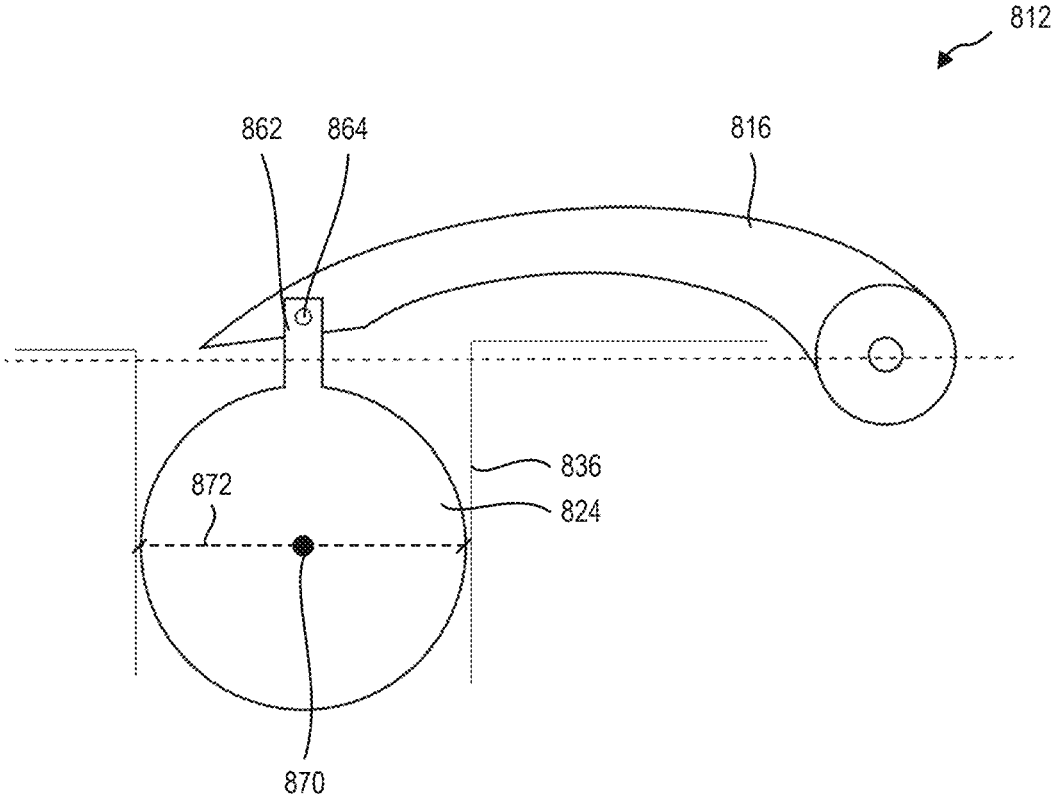
FIG. 8 is a side cross-sectional view of an embodiment of a directional steering tool with a spherical piston in a linear cylindrical bore.

FIG. 8 is a side cross-sectional view of another embodiment of a directional steering tool 812 with a spherical piston 824 in a linear cylindrical bore 836. In some embodiments, the piston 824 rotates within the bore 836 about a transverse axis 870 as the connecting rod 862 moves with the contact surface of the actuatable biasing element 816. In some embodiments, the connecting rod 862 is rotatable relative to the contact surface by a rotatable connection 864. The connecting rod 862 therefore, rotates as the contact surface moves laterally relative to the bore 836, which applies a torque to the piston 824 to rotate the piston 824 around the transverse axis 870 of the spherical piston 824.

In some embodiments, the spherical piston 824 has a transverse dimension 872 (i.e., diameter or other dimension transverse to the axial direction of the bore 836) that is substantially equal to that of the bore 836. As the spherical piston 824 rotates in the bore 836, the transverse dimension 872 remains substantially the same. For example, the cross-sectional shape and/or area of the piston 824 relative to a transverse direction of the bore 836 remains substantially the same through a range of motion of the spherical piston 824 and the actuatable biasing element 816.

While the embodiment of a piston 824 has been described herein as a spherical piston, it should be understood that the piston 824 may be a portion of a sphere such that a cross-sectional shape and/or area of the piston 824 relative to a transverse direction of the bore 836 remains substantially the same through a range of motion of the spherical piston 824 and the actuatable biasing element 816.

In some embodiments, the piston 824 is non-spherical, but has another shape that has a cross-sectional shape and/or area of the piston 824 relative to a transverse direction of the bore 836 remains substantially the same through a range of motion of the spherical piston 824 and the actuatable biasing element 816. In some embodiments, the piston 824 includes any piston body that maintains a complementary cross-section to the bore 836 perpendicular to the axial direction of travel through the bore 836. For example, an ellipsoid piston in an elliptical bore or a cylinder piston (having a longitudinal direction of the cylinder perpendicular to the axial direction of the bore) in a rectangular bore each are rotatable relative to the bore 836 and maintain a complementary cross-section to the bore 836 perpendicular to the axial direction of travel through the bore 836.

In some embodiments, a rotatable piston 824 includes a monolithic piston body including a superhard or ultrahard material. In some embodiments, the rotatable piston 824 includes a piston body with a superhard (or ultrahard) coating or outer layer that is proximate to the bore 836. In some embodiments, the outer layer of the piston 824 is a pressure ring around a piston body where the pressure ring has a cross-sectional shape and/or area relative to a transverse direction of the bore 836 that remains substantially the same through a range of motion of the piston 824 and the actuatable biasing element 816.

Embodiments of the present disclosure generally relate to devices, systems, and methods for controlling a downhole tool in a downhole environment. Embodiments of the present disclosure generally relate to devices, systems, and methods for directional drilling. In some embodiments, systems and methods according to the present disclosure allow for the selective cutting, drilling, milling, reaming, degrading, or otherwise removing material to steer a drill bit in a downhole environment. In some embodiments, systems and methods according to the present disclosure allow for the removal of material from formation in a lateral direction during drilling of the borehole. In some embodiments, systems and methods according to the present disclosure allow for the removal of material from the formation based at least partially on information received from one or more sensors in the bottomhole assembly. It should be understood that while the present disclosure will describe the systems and methods for directional drilling of a wellbore, it should be understood that the present disclosure is applicable to any downhole device with actuatable structures on a lateral surface during or after the creation of a borehole.

In some embodiments, a directional steering tool includes at least one actuatable biasing element configured to actuate radially outward from a rotational axis of the BHA and/or drill string. In some embodiments, the actuatable biasing element is movable around a hinged connection to the tool housing of the directional steering tool. In some embodiments, the actuatable biasing element is urged radially outward by a hydraulic actuator including a piston. The linear movement of the piston in the hydraulic actuator urges the actuatable biasing element through an arcuate range of motion relative to the hinged connection. A top surface of the piston applies a radially outward force to the actuatable biasing element, and the top surface slides relative to a contact surface of the actuatable biasing element as the actuatable biasing element rotates through the arcuate range of motion. While this geometry allows for a hydraulic actuator to apply a radially outward force to the actuatable biasing element, the lack of axial coupling (relative to an axial direction of the piston) between the piston and the actuatable biasing element prevents the piston from applying a radially inward force (e.g., tension force) to the actuatable biasing element.

The piston may be axially coupled to the actuatable biasing element when the piston moves in a toroidal bore with a substantially similar arcuate path of the actuatable biasing element. In some embodiments, the piston is coupled to the actuatable biasing element and is fixed relative to the actuatable biasing element. As the actuatable biasing element moves through an arcuate range of motion relative to the hinged connection, in some embodiments, the piston moves in an arcuate path that is substantially similar to the arcuate range of motion of the actuatable biasing element.

In some embodiments, the piston moves within a toroidal bore. In some embodiments, the toroidal bore has a radius of curvature that is substantially equal to the radius of the contact surface of the actuatable biasing element relative to the hinged connection. For example, the arcuate path of the piston coupled to the contact surface of the actuatable biasing element both follow the same path as the actuatable biasing element moves through the arcuate range of motion.

In some conventional hydraulic pistons, an elastomeric seal around a lateral edge of the piston between the piston and the bore provides a fluid seal between the piston and the bore. In a downhole environment, the environmental conditions and fluid properties damage elastomeric seals. In some embodiments, a piston, according to the present disclosure, includes a pressure ring coupled to the piston body. The pressure ring includes a superhard or ultrahard material to resist wear in the downhole environment, as will be described in more detail herein. In some embodiments, the pressure ring has a circular outer perimeter (i.e., circumference). In some embodiments, the pressure ring is an annular ring around a portion of the piston body and between the piston and the inner diameter of the bore.

In some embodiments, the pressure ring is oriented on the piston to align with the radial direction of the hinged connection. When used in conjunction with a toroidal bore with a radius of curvature based on the hinged connection, a pressure ring in-plane with the radial direction remains fixed in a position normal to the arcuate path of the piston in the toroidal bore. In some embodiments, a circular or annular pressure ring that is in-plane with the radial direction is rotatable relative to the toroidal bore in-plane with the radial direction. For example, the pressure ring may experience wear from contact with the wall of the bore and/or erosion from fluid flow through a gap between the outermost edge of the pressure ring (radially outermost relative to a center of the pressure ring) and the wall of the bore. A pressure ring that is rotatable relative to the piston body allows the pressure ring to experience the wear and/or erosion distributed around a broader region of the pressure ring, increasing the operational lifetime of the device.

In some embodiments, the pressure ring is non-circular and/or non-annular. For example, the pressure ring may be complementarily shaped to a cross-section of the bore to fit in the bore and receive fluid pressure across a surface of the pressure ring, but the pressure ring and the cross-sectional shape of the bore may be non-circular, such as elliptical, square, rectangular, hexagonal, other regular or irregular polygonal, regular or irregularly curved, or combinations thereof. Such a shape of the pressure ring and the cross-sectional shape of the bore limits and/or prevents rotation of the pressure ring relative to the cross-sectional shape of the bore. In some embodiments, limiting rotation of the pressure ring relative to the bore controls the relative position of the pressure ring and the wall of the bore when more precise tolerances are desired.

In some embodiments, a plane of the pressure ring is oriented at an angle to the radial direction. For example, an elliptical pressure ring oriented at an angle to the arcuate path of the piston complementarily fits in a toroidal bore with a circular cross-sectional shape transverse to the axial direction of the bore. An elliptical pressure ring in a bore with a circular cross-sectional shape limits and/or prevents rotation of the pressure ring in the bore and/or directs fluid flow (and erosion associated therewith) to a region of the gap between the pressure ring and the bore wall.

In some embodiments, the gap between the pressure ring and the wall of the bore allows for larger machining and/or manufacturing tolerances. Precise manufacturing or dimensions or surface finish can be challenging with ultrahard materials. A pressure ring including ultrahard materials, however, has increased erosion resistance relative to a conventional elastomeric seal, allowing the pressure ring to experience fluid flow through the gap without significant erosion. In some embodiments, the gap is in a range having an upper value, a lower value, or upper and lower values including any of 1% of a diameter (such as the diameter described herein or another maximum transverse dimension) of the pressure ring, 2%, 3%, 5%, or any values therebetween of the diameter (or other maximum transverse dimension) of the pressure ring.

In some embodiments, the piston includes a pressure ring that is captured between a first portion of the piston body and a second portion of the piston body. In some embodiments, a threaded fastener couples the pressure ring to the piston body. In some embodiments, the threaded fastener couples the first portion of the piston body to the second portion of the piston body, and the pressure ring is captured therebetween, although the threaded fastener may or may not directly contact the pressure ring. In some embodiments, the fastener or other mechanism that connects the pressure ring to the piston also connects the piston to the actuatable biasing element (such as coupled to the contact surface described herein). In some embodiments, the piston is coupled to the actuatable biasing element (e.g., axially coupled as described herein) by a different and/or separate connection mechanism.

In other embodiments, additional or other fasteners or fastening mechanisms are included. For example, a piston may include two or more fasteners in addition to a central fastener. In some examples, a piston includes two or more fasteners and lack a central fastener. In some examples, a piston includes an adhesive that bonds the pressure ring to the piston body. In some examples, a piston includes a magnetic connection that retains the pressure ring against or in the piston body.

In some embodiments, an outermost edge of the pressure ring has a ring diameter (or other maximum dimension for non-circular pressure rings) that is greater than a body diameter of the piston body. The prominence of the pressure ring beyond the piston body in the transverse direction is, in some embodiments, in a range having an upper value, a lower value, or upper and lower values including any of 1% of the ring diameter (or another maximum transverse dimension) of the pressure ring, 2%, 3%, 5%, 10%, or any values therebetween of the ring diameter (or other maximum transverse dimension). For example, the prominence is greater than 1% of the ring diameter. In some examples, the prominence is less than 10% of the ring diameter. In some examples, the prominence is between 1% and 10% of the ring diameter. In some examples, the prominence is between 2% and 5% of the ring diameter.

In some embodiments, the pressure ring is a monolithic component. In some examples, the pressure ring is a single continuous piece of polycrystalline diamond (PCD). In some examples, the pressure ring is a single continuous piece of tungsten carbide (WC). In some examples, the pressure ring is a single continuous piece of silicon carbide (SiC). In some examples, the pressure ring is a single continuous piece of cubic boron nitride (cBN). In some embodiments, the pressure ring is a multi-component pressure ring. For example, the pressure ring may include a plurality of angular segments in the plane of the pressure ring. In some examples, the pressure includes a plurality of concentric components, such as a series of angular rings that nest concentrically within one another. In such an example, an outermost annulus of the pressure ring is a superhard or ultrahard material, and another portion of the pressure ring concentrically within the outermost annulus includes a second material, such as tool steel. For example, an outermost annulus of diamond provides greater erosion resistance and a lower coefficient of friction than the tool steel portion of the pressure ring concentrically within the outermost annulus, while the tool steel is easier to machine threads into for a threaded connection.

While embodiments of pressure rings have been described and illustrated herein with a constant thickness in the axial direction, in some embodiments, a pressure ring has a non-uniform thickness. In some embodiments, the piston has a pressure ring coupled to or captured in a piston body where a first surface and a second surface of the pressure ring are non-parallel to one another. For example, at least a portion of the first surface and the second surface form a wedge angle. In some embodiments, the wedge angle is in a range having an upper value, a lower value, or an upper and lower value including any of 1°, 2°, 3°, 4°, 5°, 6°, 8°, 10°, or any values therebetween. In some examples, the wedge angle is greater than 1°. In some examples, the wedge angle is less than 10°. In some examples, the wedge angle is between 1° and 10°. In at least one embodiment, the wedge angle is between 1° and 5°. A wedge pressure ring further limits and/or prevents rotation of the pressure ring relative to the piston body and/or in the bore.

In some embodiments, the wedge pressure ring has a greater erosive volume to last longer during operation. For example, the flow rate of a hydraulic fluid may be greater through the gap with the toroidal bore at the radially outermost edge of the pressure ring (relative to the hinged connection). In some embodiments, an edge of the pressure ring (e.g., radially outermost edge or any edge of any embodiment of a pressure ring described herein) is rounded. In some embodiments, an edge of the pressure ring is tapered. In some embodiments, an edge of the pressure ring is squared with discontinuous corners. In some embodiments, at least a portion of the edge is radiused (i.e., curved) and at least a portion of the edge is linear.

In some embodiments, the piston moves within a linear bore. To accommodate the lateral component of the contact surface of the actuatable biasing element during the arcuate range of motion relative to the piston, a connecting rod axially couples the piston to the actuatable biasing element. The connecting rod is rotatably coupled to the piston at a first rotatable connection (e.g., proximate to the top surface), and the connecting rod is rotatably coupled to the contact surface (or another portion of the actuatable biasing element at a second rotatable connection). In some embodiments, the rotatable connection is a hinged connection with a single rotational axis. In some embodiments, the rotatable connection includes a plurality of rotational axis, such as a universal joint including a plurality of hinged connections. In some embodiments, the rotatable connection is a ball-and-socket connection that allows additional axes of rotation.

In some embodiments, a piston axially coupled to the actuatable biasing element with a connecting rod with rotatable connections able to rotate independently of actuatable biasing element. A pressure ring or plurality of pressure rings with an axial length of at least 10% of the ring diameter limits and/or prevents unintended rotation of the piston relative to the bore. In some embodiments, the axial length of the pressure ring or plurality of pressure rings is at least 20% of the ring diameter. In some embodiments, the axial length of the pressure ring or plurality of pressure rings is at least 30% of the ring diameter.

In some embodiments, the piston has a first pressure ring and a second pressure ring that define an axial length from the first pressure ring to the second pressure ring. In some embodiments, the piston includes a third pressure ring in addition to the first pressure ring and the second pressure ring. In some embodiments, the first pressure ring is the same as the second pressure ring. For example, it may be beneficial to have redundant and/or shared parts between the first pressure ring and the second pressure ring. In some embodiments, the first pressure ring and second pressure ring are different. In some examples, the first pressure ring and second pressure ring include different materials, such as the first pressure ring being or including diamond and the second pressure ring being or including cBN. In some examples, the first pressure ring and second pressure ring have different thicknesses (e.g., axial lengths). In some examples, the first pressure ring and second pressure ring have different ring diameters. In some examples, the first pressure ring and second pressure ring have different prominences beyond the sides of the piston body.

In some embodiments, the linkage of the connecting rod through two rotatable connections allows the relative lateral movement between the contact surface and the top surface. The connecting rod is, therefore, able to rotate relative to the piston while the piston moves in a linear path through the linear bore (or linear portion of the bore), and the connecting rod is able to rotate relative to the contact surface of the actuatable biasing element while the actuatable biasing element rotates around the hinged connection.

In some embodiments, the piston rotates within the bore about a transverse axis as the connecting rod moves with the contact surface of the actuatable biasing element. In some embodiments, the connecting rod is rotatable relative to the contact surface by a rotatable connection. The connecting rod, therefore, rotates as the contact surface moves laterally relative to the bore, which applies a torque to the piston to rotate the piston around the transverse axis of the spherical piston.

In some embodiments, the spherical piston has a transverse dimension (i.e., diameter or other dimension transverse to the axial direction of the bore) that is substantially equal to that of the bore. As the spherical piston rotates in the bore, the transverse dimension remains substantially the same. For example, the cross-sectional shape and/or area of the piston relative to a transverse direction of the bore remains substantially the same through a range of motion of the spherical piston and the actuatable biasing element.

While the embodiment of a piston has been described herein as a spherical piston, it should be understood that the piston may be a portion of a sphere such that a cross-sectional shape and/or area of the piston relative to a transverse direction of the bore remains substantially the same through a range of motion of the spherical piston and the actuatable biasing element.

In some embodiments, the piston is non-spherical, but has another shape that has a cross-sectional shape and/or area of the piston relative to a transverse direction of the bore remains substantially the same through a range of motion of the spherical piston and the actuatable biasing element. In some embodiments, the piston includes any piston body that maintains a complementary cross-section to the bore perpendicular to the axial direction of travel through the bore. For example, an ellipsoid piston in an elliptical bore or a cylinder piston (having a longitudinal direction of the cylinder perpendicular to the axial direction of the bore) in a rectangular bore each are rotatable relative to the bore and maintain a complementary cross-section to the bore perpendicular to the axial direction of travel through the bore.

In some embodiments, a rotatable piston includes a monolithic piston body including a superhard or ultrahard material. In some embodiments, the rotatable piston includes a piston body with a superhard (or ultrahard) coating or outer layer that is proximate to the bore. In some embodiments, the outer layer of the piston is a pressure ring around a piston body where the pressure ring has a cross-sectional shape and/or area relative to a transverse direction of the bore that remains substantially the same through a range of motion of the piston and the actuatable biasing element.

It should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein, to the extent such features are not described as being mutually exclusive. Numbers, percentages, ratios, or other values stated herein are intended to include that value, and also other values that are "about", "substantially", or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims. The described embodiments are therefore to be considered as illustrative and not restrictive, and the scope of the disclosure is indicated by the appended claims rather than by the foregoing description.

What is claimed is:

1. A downhole tool comprising:

a tool housing having an outer surface;

a movable biasing element radially movable relative to the outer surface;

a bore in the outer surface of the tool housing at least partially in a radial direction of the tool housing;

a piston axially fixed to the movable biasing element and movable in the bore, wherein the piston has a first portion and a second portion, and wherein the first portion is separate and distinct from the second portion; and a pressure ring coupled to the piston and positioned between the first portion of the piston and the second portion of the piston in an axial direction.

2. The downhole tool of claim 1, wherein the bore has a superhard or ultrahard surface.

3. The downhole tool of claim 1, wherein the pressure ring has a superhard or ultrahard surface.

4. The downhole tool of claim 1, wherein the pressure ring has a ring diameter greater than 95% of an inner diameter of the bore.

5. The downhole tool of claim 4, wherein the ring diameter of the pressure ring is no more than 98% of the inner diameter of the bore.

6. The downhole tool of claim 1, wherein the pressure ring is an annular ring with an inner diameter less than 50% of an inner diameter of the bore.

7. The downhole tool of claim 1, wherein the bore is toroidal.

8. The downhole tool of claim 1, further comprising a fastener coupling the first portion of the piston to the second portion of the piston.

9. The downhole tool of claim 8, wherein the fastener couples the pressure ring to the first portion of the piston and the second portion of the piston.

10. The downhole tool of claim 8, wherein the fastener couples the piston to the movable biasing element.

11. The downhole tool of claim 1, wherein the pressure ring has a ring diameter greater than an outer diameter of the piston.

12. A downhole tool comprising:

a tool housing having an outer surface;

a movable biasing element radially movable relative to the outer surface;

a bore in the outer surface of the tool housing at least partially in a radial direction of the tool housing;

a piston operably coupled to the movable biasing element and axially movable in the bore and rotatable in the bore around a transverse axis in a transverse direction to an axial direction of the bore; and a connecting rod axially coupled to the movable biasing element and the piston, wherein the connecting rod is rotatably connected to the movable biasing element.

13. The downhole tool of claim 12, wherein the piston has a cross-sectional shape in the transverse direction of the bore that is complementary to a cross-sectional shape of the bore in the transverse direction through a range of motion of the movable biasing element relative to the outer surface.

14. The downhole tool of claim 12, wherein the piston is a cylindrical piston having a longitudinal axis oriented in the transverse direction.

15. The downhole tool of claim 12, wherein the piston is a spherical piston.

16. The downhole tool of claim 12, further comprising:

a pressure ring coupled to the piston and positioned between at least a portion of the piston and an inner wall of the bore.

17. A downhole tool comprising:

a tool housing having an outer surface;

a movable biasing element radially movable relative to the outer surface;

a bore in the outer surface of the tool housing at least partially in a radial direction of the tool housing;

a piston movable in the bore;

a first pressure ring coupled to the piston and positioned between at least a portion of the piston and an inner wall of the bore;

a second pressure ring coupled to the piston and positioned between at least the portion of the piston and the inner wall of the bore, wherein the first pressure ring is disposed apart from the second pressure ring; and a connecting rod axially coupled to the movable biasing element and the piston, wherein the connecting rod is rotatably connected to the movable biasing element and rotatably connected to the piston.

18. The downhole tool of claim 17, wherein the connecting rod is connected to at least one of the movable biasing element and the piston by a ball-and-socket connection.

19. The downhole tool of claim 17, wherein the first pressure ring includes a different material, has a different thickness, has a different diameter, or any combination thereof, relative to the second pressure ring.

20. The downhole tool of claim 17, further comprising a third pressure ring coupled to the piston and positioned between at least the portion of the piston and the inner wall of the bore, wherein the third pressure ring is disposed apart from the first pressure ring and the second pressure ring.

* * * * *